US006654585B2

(12) United States Patent
Hattori

(10) Patent No.: US 6,654,585 B2
(45) Date of Patent: Nov. 25, 2003

(54) INDUCTIVE THERMAL FIXING DEVICE FOR IMAGE FORMING DEVICE

(75) Inventor: Tomoaki Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/098,353

(22) Filed: Mar. 18, 2002

(65) Prior Publication Data

US 2002/0131798 A1 Sep. 19, 2002

(30) Foreign Application Priority Data

Mar. 19, 2001 (JP) ..... P2001-077484

(51) Int. Cl.[7] ..... G03G 15/20

(52) U.S. Cl. ..... 399/328; 219/216; 219/619; 399/330

(58) Field of Search ..... 399/328, 330, 399/334; 219/619, 672, 674, 216, 467

(56) References Cited

U.S. PATENT DOCUMENTS 4,570,044 A * 2/1986 Kobayashi et al. ..... 219/619

FOREIGN PATENT DOCUMENTS

| | | | |
|---|---|---|---|
| JP | A 9-319243 | | 12/1997 |
| JP | 10-83126 A | * | 3/1998 |
| JP | 10-111612 A | * | 4/1998 |
| JP | A 10-207269 | | 8/1998 |

* cited by examiner

*Primary Examiner*—Joan Pendegrass
(74) *Attorney, Agent, or Firm*—Oliff & Berridge, PLC

(57) ABSTRACT

A thermal fixing device is for thermally fixing an image to a recording medium. The thermal fixing device includes an induction coil, a propagation member, and a thermal roller. The propagation member is made from a magnetic material that propagates magnetic flux induced by the induction coil. The thermal roller has a thermal region including an outer peripheral surface and an inner peripheral surface. One or both of the outer peripheral surface and the inner peripheral surface of the thermal region is formed from a magnetic material. The propagation member is magnetically connected to both axial lengthwise ends of magnetic-material ones of the outer peripheral surface and at the inner peripheral surface.

21 Claims, 4 Drawing Sheets

18

118

INDUCTIVE THERMAL FIXING DEVICE FOR IMAGE FORMING DEVICE

BACKGROUND OF THE INVENTION

1. Field of the Invention

The present invention relates to a thermal fixing device of an image forming device.

2. Description of the Related Art

Image forming devices, such as laser printers, normally have a thermal fixing device for fixing toner that has been transferred onto a sheet. The thermal fixing device includes a thermal roller and a pressing roller. The thermal fixing device thermally fixes the toner onto the sheet while the sheet passes between the thermal roller and the pressing roller.

The thermal roller of the thermal fixing device normally is a tube. A halogen heater is mounted in the tube following the axial direction of the tube. The halogen heater heats up the tube.

Recently, a thermal fixing device has been proposed wherein the tube is heated directly by induction. A plurality of induction coils are disposed on the tube following the axial direction of the tube. An alternating current if passed through each of the induction coils to generate an induced magnetic flux. The induced magnetic flux induces a current at surface portions of the tube that confront one of the induction coils. Joule heat associated with the induced current heats up the surface portions of the tube. As a result, the entire surface of the tube is heated up directly.

However, the Joule heat that heats the tube can heat up and damage the induction coils on the tube. Also, it is expensive to provide the plurality of induction coils following the axial direction of the tube.

One conventional thermal fixing device includes a single induction coil disposed in confrontation with the entire axial length of the tube. Providing a single induction coil instead of a plurality of induction coils reduces costs. However, in this case the magnetic flux is concentrated at the axial ends of the tube and weaker at the central portion of the tube. As a result, the ends of the tube heat up excessively and the center heats up insufficiently. Such a configuration cannot heat up the tube uniformly.

SUMMARY OF THE INVENTION

It is an objective of the present invention to overcome the above-described problems and provide a thermal fixing device that uses induction heating to uniformly heat a thermal region of a thermal member for thermally fixing an image onto a recording medium, the thermal fixing device having a compact and simple configuration, enhanced durability, and reduced cost.

In order to achieve the above-described objectives, a thermal fixing device according to the present invention includes a magnetic circuit configured from an induction coil, a propagation member, and a thermal member. The propagation member is made from a magnetic material that propagates magnetic flux induced by the induction coil. The thermal member has a thermal region made from a magnetic material. The propagation member is magnetically connected to both ends of the thermal region of the thermal member so that the magnetic flux induced by the induction coil heats the thermal region of the thermal member.

With this configuration, when an alternating current is applied to the induction coil, then an induced magnetic flux propagates through the propagation member and an induced current is generated from one end to the other of the thermal region of the heated member. Joule heat associated with the induced current directly heats up the thermal region. For this reason, the entire thermal region can be directly and uniformly heated up across its entire axial length without providing a plurality of induction coils in confrontation with the thermal region across the length of the heated member. Accordingly, the induction coil will not be damaged so that durability can be enhanced. Also, the thermal region of the heated member for thermally fixing the recording medium can be uniformly heated using an induction heating method using only a simple configuration.

It is desirable that the entire thermal region of the thermal member propagate the induced magnetic flux so that magnetic flux is induced across the entire thermal region of the thermal member from one end to the other of the thermal region. As a result, the entire thermal region heats up at the same time. For this reason, the thermal region can be even more uniformly heated up using a simple induction heating configuration.

When the induction coil and the propagation member are stationary and the thermal member is movable, there will be situations when a gap will exist between the thermal member and at least one of the induction coil and the propagation member so that the thermal member can move with respect to the induction coil and the propagation member. The gap will increase the magnetic reluctance between the movable thermal member and the induction coil and the propagation member. In this case, it is desirable to provide a magnetic reluctance reducer for reducing magnetic reluctance between the propagation member and the thermal member so that the induced magnetic flux from the stationary propagation member can be propagated to the thermal region of the movable thermal member. As a result, the magnetic reluctance at the gap can be reduced so that induction heating can be efficiently achieved.

It is desirable that the magnetic reluctance reducer increase the surface area that propagates the induced magnetic flux from the propagation member so that the induced magnetic flux is propagated to the thermal region. As a result, the magnetic reluctance can be reliably reduced and efficient induction heating can be easily and reliably achieved.

It is desirable that the magnetic reluctance reducer serves as a support for the movable thermal member, so that the number of components can be reduced so that induction heating can be performed reliably with a simple configuration.

It is desirable that the induction coil be provided to the outside of the movable thermal member, with respect to the lengthwise direction of the movable thermal member, so that the thermal fixing device can be formed in a more compact shape. Also, with this configuration, the induction coil is less likely to be damaged from heat generated from the thermal region of the thermal member.

When the induction coil is provided around the propagation member at a position external from the movable thermal member in the lengthwise direction of the movable thermal member, it is desirable that the induction coil be installed with respect to the movable thermal member in an integral manner with the connection end portion of the propagation member. With this configuration, during assembly of the thermal fixing device, the induction coil can be provided external from the movable thermal member in the lengthwise direction of the movable thermal member by merely mounting the connection end portion of the propagation member to the movable thermal member. For this reason, the induction coil can be reliably provided to the outside of the movable thermal member in the lengthwise direction of the movable thermal member by a simple assembly process and the thermal fixing device can be made in a more compact shape.

It is desirable that the induction coil be provided around the propagation member at a position external from an axial direction end of the roller so that the thermal fixing device can be made more compact. In this case, it is further desirable that the roller surface have a larger magnetic reluctance than magnetic reluctance of the propagation member so that efficient induction heating can be reliably achieved.

It is desirable that the propagation member be adapted for changing length of a pathway through the thermal region where the propagation member propagates the induced magnetic flux. With this configuration, if the size of the recording medium is changed, then the thermal region can be changed to a size that matches the size of the recording medium by changing the length of the pathway through the thermal region where the propagation member propagates the induced magnetic flux. For this reason, thermal fixing can be appropriately and efficiently performed in accordance with size of the recording medium.

The length of the pathway through which the induced magnetic flux propagates through the thermal region can be changed by configuring the propagation member with first and second propagation members. The first propagation member is magnetically connected to both lengthwise ends of the movable thermal member. The second propagation member is interposed between a non-end portion of the first propagation member and a lengthwise non-end portion of the movable thermal member. The second propagation member is switchably movable between a connection orientation and an interruption orientation. In the connection orientation, the second propagation member magnetically connects the non-end portion of the first propagation member and the lengthwise non-end portion of the movable thermal member. In the interruption orientation, magnetic connection between the non-end portion of the first propagation member and the lengthwise non-end portion of the movable thermal member is interrupted.

With this configuration, when the second propagation member is in the interruption orientation, then the induced magnetic flux propagates through the first propagation member, which is connected to the both lengthwise end portions of the movable thermal member. Therefore, the entire length of the movable thermal member serves as the thermal region. When the second propagation member is in the connection orientation, then the non-end portion of the first propagation member and the lengthwise non-end portion of the movable thermal member are connected so that the portion of the movable thermal member that corresponds to the non-end portion of the first propagation member and the movable thermal member serves as the thermal region. The thermal region can be easily and reliably changed by merely switching the second propagation between its interruption orientation and its connection orientation.

Alternatively, the length of the pathway through which the induced magnetic flux propagates through the thermal region can be changed by configuring a first propagation member to magnetically connect with a lengthwise end of the movable thermal member and a second propagation member to magnetically connect with the other lengthwise end of the movable thermal member. In this case, the first and second propagation members are disposed mutually slidable along lengthwise portions thereof while maintaining magnetic connection therebetween. At least one of the first and second propagation members is slidable in the lengthwise direction of the movable thermal roller while maintained in a magnetically connected condition with the movable thermal roller.

With this configuration, the thermal region can be appropriately changed by merely sliding the at least one of the first and second propagation members by an appropriate amount with respect to the movable thermal member. For this reason, the thermal region can be easily and reliably changed in a continuous manner. Thermal fixation can be performed even more efficiently and appropriately in accordance with the size of the recording medium.

It is desirable that the thermal member be configured from at least one layer of a magnetic material and at least one layer of a material with a thermal conductivity that is higher than thermal conductivity of the layer of magnetic material. Because at least one layer is formed from a magnetic material, the magnetic layer can be properly heated so that proper thermal fixation can be achieved. Also, even if local areas of the magnetic layer are cooled off by the recording medium contacting the thermal member, the heat from other areas will be properly dispersed to the contacted areas because at least one layer is formed from a material with a thermal conductivity that is higher than thermal conductivity of the layer of magnetic material. Therefore, drops in temperature of the thermal member can be prevented. For this reason, thermal fixation can be performed even more efficiently.

In this case, it is desirable that the thermal member includes two outer layers formed from a magnetic material, and an intermediate layer interposed between the outer layers. The intermediate layer is formed from a material with higher thermal conductivity than thermal conductivity of the outer layers. With this configuration, the current induced by the magnetic field occurring by propagation of the induced magnetic flux is generated in the upper and lower layers with the intermediate layer interposed therebetween. Therefore, efficient induction heating can be achieved.

When a casing is provided that covers the movable thermal member, it is desirable that the propagation member be provided integrally with the casing. As a result, configuration can be simplified and costs can be reduced because the number of components is reduced. In this case, it is desirable that the propagation member include a casing-side propagation member and a connection-side propagation member that are separable connected to each other. With this configuration, the casing-side propagation member and the connection-side propagation member of the propagation member separate from each other when the casing is detached from the movable thermal member, so that the casing-side propagation member is detached along with the casing. Therefore, during maintenance for example, there is no need to detach the propagation member in an action separate from the action of detaching the casing. Maintenance can be simplified.

According to another aspect of the present invention, a thermal fixing device includes a thermal member and a magnetic circuit. The thermal member has a thermal region including an outer surface and an inner surface. At least one of the outer surface and the inner surface of the thermal region is formed from a magnetic material. The magnetic circuit generates an eddy current at the at least one of the outer surface and at the inner surface of the thermal region of the thermal member.

By generating an eddy current at at least one of the outer surface and the inner surface of the thermal member, the thermal region, which is formed at least partially from magnetic material in this way, generates heat so that the thermal region can be directly heated. For this reason, the thermal region of the thermal member for performing thermal fixation on a recording medium can be uniformly heated using an induction heating method using only a simple configuration.

According to still another aspect of the present invention, thermal fixing device includes an induction coil, a propagation member, and a thermal roller. The propagation member is made from a magnetic material that propagates magnetic flux induced by the induction coil The thermal roller has a thermal region including an outer peripheral surface and an inner peripheral surface. One or both of the outer peripheral surface and the inner peripheral surface of the thermal region is formed from a magnetic material. The propagation member is magnetically connected to both axial lengthwise ends of magnetic-material ones of the outer peripheral surface and at the inner peripheral surface.

The thermal fixing device according to these aspects of the present invention can be effectively provided to an image forming device including a developing unit for forming the image and a transfer unit for transferring the image onto the recording medium.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENTS

Figure 1:
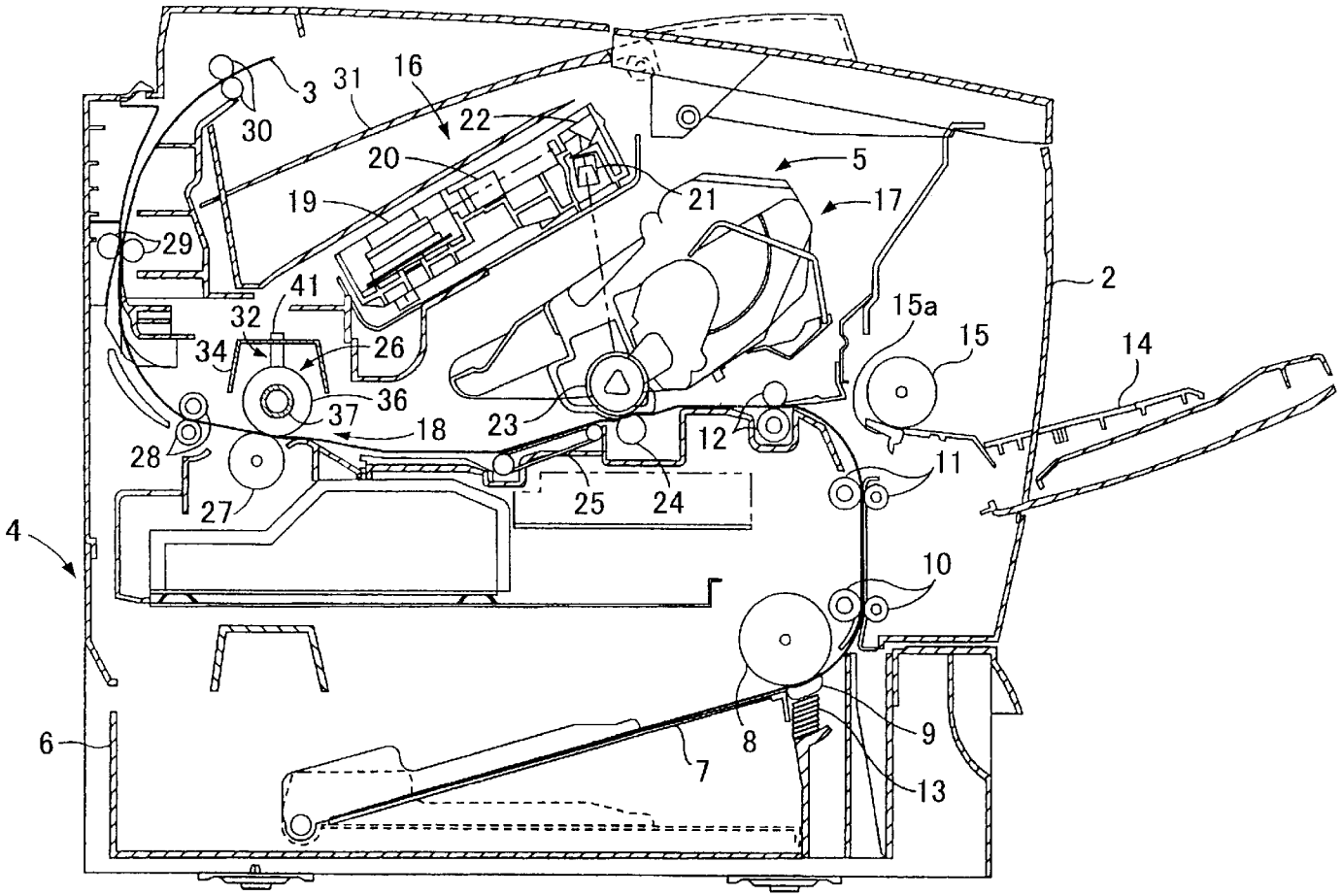
FIG. 1 is a cross-sectional side view showing essential portions of a laser printer according to a first embodiment of the present invention.

Next, laser printers according to embodiments of the present invention will be explained while referring to the attached drawings.

First, a laser printer 1 according to a first embodiment of the present invention will be explained while referring to FIGS. 1 to 5. The laser printer 1 includes a main casing 2, a feeder portion 4 for feeding sheets 3, and an image forming portion 5 for forming images on the sheets 3 fed out by the feeder portion 4. The feeder portion 4, the image forming portion 5, and other components are provided in the main casing 2.

The feeder portion 4 includes a sheet-supply tray 6, a sheet-pressing plate 7, a sheet-feed roller 8, a sheet-feed pad 9, transport rollers 10, 11, and registration rollers 12. The sheet-supply tray 6 is detachably mounted in the lower portion of the main casing 2. The sheet-pressing plate 7 is provided in the sheet-supply tray 6. The sheet-feed roller 8 and the sheet-feed pad 9 are disposed above one end of the sheet-supply tray 6. The transport rollers 10, 11 are disposed downstream from the sheet-feed roller 8 with respect to the transport direction of the sheets 3. Hereinafter, positions upstream and downstream with respect to the transport direction of the sheets 3 will be simply referred to as "upstream" or "downstream." The registration rollers 12 are configured from a pair of rollers provided downstream from the transport rollers 10, 11.

The sheet-pressing plate 7 is stacked with a pile of sheets 3, and is pivotably supported at the end farthest from the sheet-feed roller 8 and vertically movable at the end nearest the sheet-feed roller 8. Although not shown in the drawings, a spring is provided for urging the end of the sheet-pressing plate 7 that is nearest the sheet-feed roller 8 upward. With this configuration, the sheet-pressing plate 7 pivots downward, by an amount that depends on the number of sheets stacked on the sheet-pressing plate 7, around the end farthest from the sheet-feed roller B against the urging force of the spring. The sheet-feed roller 8 and the sheet-feed pad 9 are disposed in confrontation with each other. A spring 13 provided at the under side of the sheet-feed pad 9 presses the sheet-feed pad 9 toward the sheet-feed roller 8. The uppermost sheet 3 on the sheet-pressing plate 7 is pressed toward the sheet-feed roller 8 by the spring beneath the sheet-pressing plate 7, so that when the sheet-feed roller 8 is rotated, sheets 3 are sandwiched between the sheet-feed roller 8 and sheet-feed pad 9 and fed out one sheet at a time. The fed out sheets 3 are transported to the registration rollers 12 by the transport rollers 10, 11. After the registration rollers 12 perform a predetermined registration operation on the sheet 3, the sheet 3 is transported to the image forming portion 5.

The feeder portion 4 further includes a multi-purpose tray 14, a multi-purpose-side sheet-feed roller 15, and a multi-purpose-side sheet-feed pad 15*a*. The multi-purpose-side sheet-feed roller 15 and the multi-purpose-side sheet-feed pad 15*a* are disposed in confrontation with each other. Although not shown in the drawings, a spring is disposed at the under side of the multi-purpose-side sheet-feed pad 15*a*. The spring presses the multi-purpose-side sheet-feed pad 15*a* toward the multi-purpose-side sheet-feed roller 15. The sheets 3 that are stacked on the multi-purpose tray 14 are sandwiched between the multi-purpose-side sheet-feed roller 15 and the multi-purpose-side sheet-feed pad 15*a*, so that rotation of the multi-purpose-side sheet-feed roller 15 feeds out the sheets one at a time to the image forming portion 5.

The image forming portion 5 includes a scanner unit 16, a process cartridge 17, a transfer roller 24, and a thermal fixing device 18. The scanner unit 16 is disposed at the upper portion of the main casing 2 and includes a laser emitting portion (not shown), a polygon mirror 19, lenses 20, 21, and a reflection mirror 22. The laser emitting portion emits a laser beam based on image data. As indicated by two-dot chain line in FIG. 1, the laser light emitted from the laser emitting portion passes through or is reflected from the polygon mirror 19, the lens 20, the reflection mirror 22, and the lens 21 in this order and irradiates the surface of a photosensitive drum 23 of the process cartridge 17.

The process cartridge 17 is disposed below the scanner unit 16 and is detachably mounted to the main casing 2. The process cartridge 17 includes the photosensitive drum 23 and, although not shown in the drawings, a scorotron charge unit, a developing roller, and a toner holding portion.

The toner holding portion is filled with non-magnetic, single component, polymerized toner, which serves as a developing agent. The toner charges to a positive charge. The toner is borne on the developing roller in a thin layer with a fixed thickness. The photosensitive drum 23 is rotatably disposed in confrontation with the developing roller. The photosensitive drum has a grounded body and a surface formed with a photosensitive layer that charges to a positive charge. The photosensitive layer is formed from polycarbonate, for example.

The laser printer 1 performs an inverse development in the following manner. First, the scorotron charge unit charges the surface of the photosensitive drum 23 to a uniform positive charge in association with rotation of the photosensitive drum 23. Then, also in association with rotation of the photosensitive drum 23, the laser beam from the scanner unit 16 selectively exposes the surface of the photosensitive drum 23 at a high speed scan based on image data. The electric potential drops at portions of the uniform charge that are exposed by the laser beam, thereby forming a latent electrostatic image on the surface of the photosensitive drum 23. When the latent electrostatic image moves into confrontation with the developing roller, the positively-charged toner borne on the surface of the developing roller is supplied selectively to the latent electrostatic image, that is, to the portions with lower electric potential, to produce a visible toner image on the surface of the photosensitive drum 23. An inverse development operation is performed by selectively bearing toner on the surface of the photosensitive drum 23 in this way.

The transfer roller 24 is rotatably supported on the main casing 2 below the photosensitive drum 23 in confrontation with the photosensitive drum 23. The transfer roller is made from a metal roller shaft covered with a roller of conductive rubber material. The transfer roller 24 is applied with a predetermined transfer bias with respect to the photosensitive drum 23. As a result, the visible toner image on the surface of the photosensitive drum 23 is transferred onto the sheet 3 as the sheet 3 passes between the photosensitive drum 23 and the transfer roller 24. The sheet 3 that has had the visible toner image transferred thereto is transported to the thermal fixing device 18 via a transport belt 25.

The thermal fixing device 18 is disposed downstream from the process cartridge 17 and includes a thermal roller 26, a pressing roller 27, and a pair of transport rollers 28. The pressing roller 27 presses against the thermal roller 26. The transport rollers 28 are disposed downstream from the thermal roller 26 and the pressing roller 27.

The thermal fixing device 18 thermally fixes toner, which was transferred onto the sheet 3 while the sheet 3 was in the process cartridge 17, onto the sheet 3 as the sheet 3 passes between the thermal roller 26 and the pressing roller 27. After the thermal fixing device 18 thermally fixes the toner image onto the sheet 3, the transport rollers 28, 29, which are disposed downstream from the thermal fixing device 18, transport the sheet 3 to a sheet-discharge roller 30. The sheet 3 transported by the sheet-discharge roller 30 is discharged by the sheet-discharge roller 30 onto a sheet-discharge tray 31.

Figure 2:
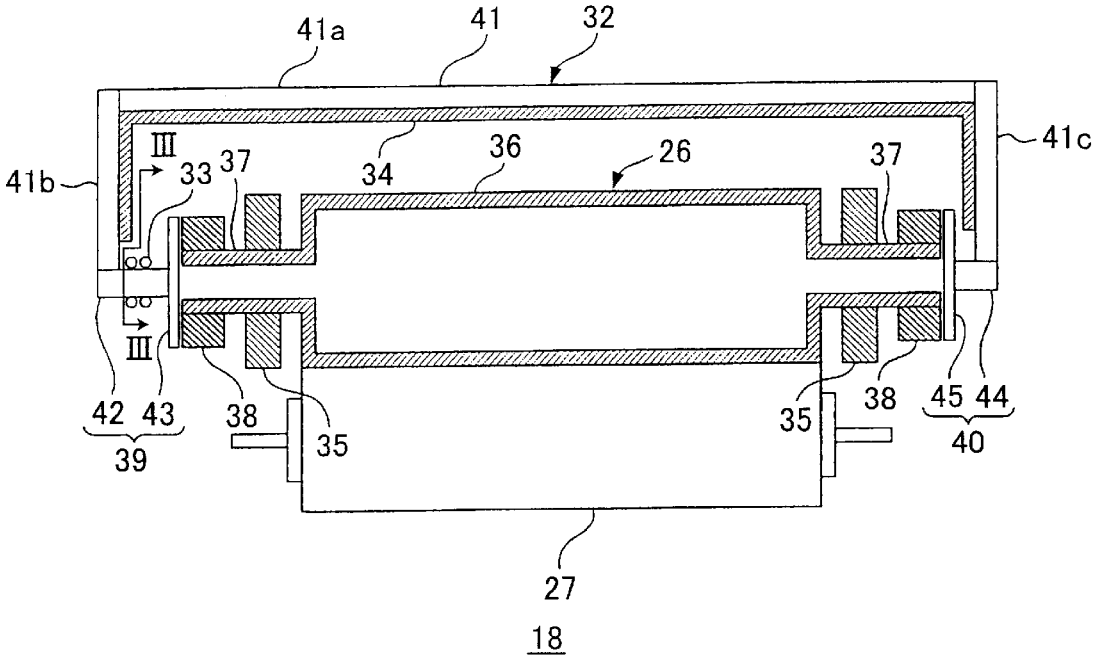
FIG. 2 is a cross-sectional vide showing components of a thermal fixing device of the laser printer of FIG. 1.

As shown in FIG. 2, the thermal fixing device 18 further includes a casing member 34, bearings 35, a stationary propagation member 32, a stationary induction coil 33, and magnetic reluctance reducers 38.

The thermal roller 26 has a hollow tube shape. As shown in FIG. 2, the thermal roller 26 is formed from a roller contact portion 36 and roller end portions 37. The roller contact portion 36 has a larger diameter than the roller end portion 37 and contacts the pressing roller 27 through the transported sheets 3. The roller end portions 37 are formed integrally to either end of the roller contact portion 36. The roller end portions 37 are rotatably supported by the bearings 35. It should be noted that, as will be explained later, the inner and outer surfaces of the thermal roller 26 is formed from a magnetic material capable of transmitting induced magnetic flux.

As shown in FIGS. 1 and 2, the casing member 34 is located above the thermal roller 26 in the main casing 2. As viewed in FIG. 1, the casing member 34 has a substantial C-shape in cross-section. The casing member 34 extends in the lengthwise direction, that is, in the axial direction, of the thermal roller 26 so as to cover the thermal roller 26 from above. Although not shown in the drawings, the wall of the casing member 34 is formed with a groove. A connection portion 41 of the propagation member 32 is fitted in the groove and locked in place by a locking member located at the side of the groove. The connection portion 41 could be attached to the external wall of the casing member 34 in other ways as well, such as by adhesive.

The propagation member 32 is formed from a magnetic material capable of propagating induced magnetic flux generated by an induction coil 33 to be described later. The propagation member 32 is desirably formed from ferrite. The propagation member 32 includes the connection portion 41 and end propagation portions 39, 40.

The connection portion 41 has a substantial C-shape as viewed in FIG. 2 and includes a long section 41*a* interposed between two short sections 41*b*, 41*c*. The long section 41*a* extends in its lengthwise direction following parallel with the axial direction of the thermal roller 26. The short sections 41*b*, 41*c* bend at a substantial right angle from the long section 41*a* and contact the axially external ends of the shaft portions 42, 44, respectively, from above. It should be noted that the short sections 41*b*, 41*c* of the connection portion 41 can be separated from the long section 41*a* of the connection portion 41. The connection portion 41 contacts the end propagation portions 39, 40 from above in a freely separable manner, that is, the connection portion 41 is merely placed on top of the end propagation portions 39, 40. However, this physical contact and the magnetic material of the connection portion 41 magnetically connects the end propagation portions 39, 40 together.

The end propagation portions 39, 40 are fixed in place at a position that is adjacent to the roller end portions 37 at either axial end of the thermal roller 26. That is, although not shown in the drawings, support members supported by the bearings 35 are provided for fixedly supporting the end propagation portions 39, 40. The end propagation portions 39, 40 include integrally formed shaft portions 42, 44 and propagation plates 43, 45, respectively. The shaft portions 42, 44 extend in the axial direction of the thermal roller 26.

Figure 3:
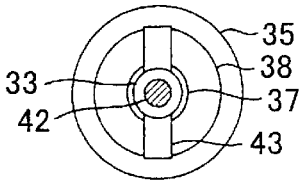
FIG. 3 is a cross-sectional view taken along line III—III of FIG. 2.

The propagation plates 43, 45 are connected to the shaft portions 42, 44, respectively. As shown in FIG. 3, the propagation plates 43, 45 have a substantial rectangular plate shape and are oriented substantially perpendicular to the shaft portions 42, 44, respectively. The propagation plates 43, 45 are disposed in close confrontation with the axially external ends of the roller end portions 37, which are rotatably supported by the bearings 35. It should be noted that the propagation plates 43, 45 are not physically connected to the roller end portions 37, but are separated from the axially external ends of the roller end portions 37 by a small gap.

As described above, the connection portion 41 is attached to the external wall of the casing member 34 and is detachable with respect to the shaft portions 42, 44 of the end propagation portions 39, 40. Also, the casing member 34 is supported freely detachable with respect to the support member, so that the casing member 34 is mounted freely detachable with respect to the thermal roller 26. Maintenance is easier with this configuration. That is, to perform maintenance on the propagation member 32, the casing member 34 needs merely be detached from the thermal roller 26. Because the connection portion 41 is detachable from the end propagation portions 39, 40, and also the connection portion 41 moves integrally with the casing member 34, there is no need to detach the connection portion 41 in a separate operation from detaching the casing member 34.

The induction coil 33 is provided integrally with the shaft portion 42 of the end propagation portion 39 around the outer periphery of the shaft portion 42. Although not shown in the drawings, a power source is provided for applying an alternating current to the induction coil 33 in order to generate an induced magnetic flux.

Because the induction coil 33 is provided around the shaft portion 42 of the end propagation portion 39, which is located at the axial external end of the thermal roller 26, the thermal fixing device 18 can be made more compact and the induction coil 33 can be reliably prevented from being damaged by heat from the thermal roller 26.

Furthermore, the thermal fixing device 18 is easier to assemble because the shaft portion 42 is inserted into the induction coil 33 and made an integral part of the end propagation portion 39. That is, the induction coil 33 can be easily provided to the axial external end of the thermal roller 26 by merely attaching the end propagation portion 39 to the thermal roller 26. For example, the induction coil 33 can be made in a bobbin-type unit of a spirally-wrapped coil. After inserting the shaft portion 42 through the bobbin-type unit, the shaft portion 42 is made an integral part of the end propagation portion 39. With this configuration, the induction coil 33 can be accurately mounted around the axial external end of the thermal roller 26 using a simple assembly process. Also, the configuration can be made more compact.

The magnetic reluctance reducers 38 are each formed from a thick ring-shaped plate. The magnetic reluctance reducers 38 are fixedly fitted on the outermost position of the corresponding roller end portion 37 of the thermal roller 26 In more concrete terms, the magnetic reluctance reducers 38 are formed from ferrite. Each magnetic reluctance reducer 38 has an inner diameter that is equivalent to the outer diameter of the corresponding roller end portion 37 and an outer diameter that is substantially equal to the length of the corresponding propagation plate 43, 45. The magnetic reluctance reducers 38 each have a predetermined thickness in the axial direction of the roller end portions 37.

Figure 4:
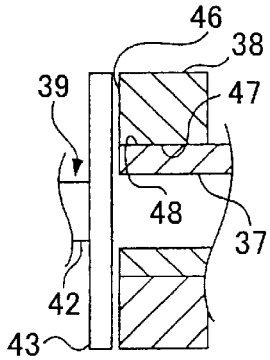
FIG. 4 is a cross-sectional view showing configuration around a left-hand magnetic reluctance reducer of FIG. 2.

Both of the magnetic reluctance reducers 38 have substantially the same configuration, so configuration of the left-hand magnetic reluctance reducer 38 will be described as a representative example with reference to FIG. 4. As shown in FIG. 4, each magnetic reluctance reducer 38 is disposed in confrontation with the corresponding propagation plate 43, but separated therefrom by a slight gap. The inner peripheral surface 47 of the magnetic reluctance reducer 38 is coupled to the outer peripheral surface 48 of the left-hand roller end portion 37 so that the left-hand magnetic reluctance reducer 38 rotates with rotation of the thermal roller 26 at a position between the left-hand propagation plate 43 and the left-hand roller end portion 37.

The magnetic reluctance reducers 38 magnetically connect the propagation plates 43, 45 of the propagation member 32 to the axial external ends of the roller end portions 37 of the thermal roller 26. As a result, the thermal roller 26, the induction coil 33, the propagation member 32, and the magnetic reluctance reducers 38 form a magnetic circuit in the thermal fixing device 18. That is, when an alternating current is applied to the induction coil 33, an induced magnetic flux propagates through the propagation member 32, that is, the end propagation portion 39, the end propagation portion 40, and the connection portion 41. As a result, an induction magnetic field is generated from the roller end portion 37 at one axial end of the thermal roller 26 to the roller end portion 37 at the other axial end of the thermal roller 26. Joule heat evolves by the induced current associated with the induction magnetic field. As a result, the thermal roller 26 is heated up directly and uniformly across its entire axial length without providing a plurality of induction coils in confrontation with the thermal roller 26 across the axial length of the thermal roller 26. Also, the induction coil 33 will not be damaged so that durability of the thermal fixing device 18 can be enhanced. Further, the thermal roller 26 for thermally fixing toner onto the sheets 3 can be uniformly heated using an induction heating method using only a simple configuration.

The propagation plates 43, 45 and the roller end portions 37 of the thermal roller 26 must be separated by a gap because the end propagation portions 39, 40 are fixedly supported and the thermal roller 26 is driven to rotate. However, this gap unavoidably increases the magnetic reluctance with respect to propagation of the induced magnetic flux. However, because the magnetic reluctance reducers 38 are interposed between the propagation plates 43, 45 and the roller end portions 37, the magnetic reluctance reducers 38 reduce the magnetic reluctance of the induced magnetic flux from the propagation plates 43, 45.

That is, because the magnetic reluctance reducers 38 are each formed with an external diameter that is substantially the same as the length of the propagation plates 43, 45, the magnetic reluctance reducers 38 are magnetically connected to the propagation plates 43, 45 at the connection surface 46 of the magnetic reluctance reducers 38 that confronts propagation plates 43, 45 as shown in FIG. 4, even though the propagation plates 43, 45 and the magnetic reluctance reducers 38 are separated by a slight gap. Therefore, the induced magnetic flux can be propagated to the roller end portions 37 of the thermal roller 26 through the coupled inner peripheral surface 47 of the magnetic reluctance reducers 38 and the outer peripheral surface 48 of the roller end portions 37. Magnetic reluctance is inversely proportional to the surface area, and proportional to the length, of the propagation pathway of the induced magnetic flux. If the magnetic reluctance reducers 38 were not provided, the gap would greatly influence the increase in magnetic reluctance, because induced magnetic flux would only be propagated in an amount corresponding to the surface area where the propagation plates 43, 45 confront the tip of the roller end portions 37. However, because the magnetic reluctance reducers 38 are provided, the confronting surface area at the tip of the roller end portions 37 is increased by the confrontation surface area between the connection surface 46 of the magnetic reluctance reducers 38 and the propagation plates 43, 45. This increase in surface area where the induced magnetic flux propagates reliably reduces the magnetic reluctance at the gap so that efficient induction heat can be simply and reliably achieved.

Figure 5:
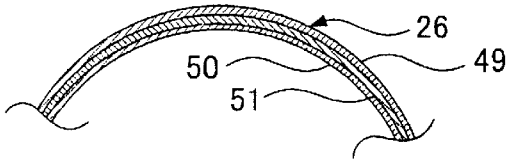
FIG. 5 is a cross-sectional view showing layered configuration of a thermal roller of the thermal fixing device.

Moreover, because the magnetic reluctance reducers 38 are formed in a ring shape and are fitted around the roller end portions 37 of the thermal roller 26, induced magnetic flux can be uniformly propagated around the entire periphery direction to the thermal roller 26. For this reason, an induction magnetic field can be generated from one end to the other end across the entire thermal roller 26 with little imbalance in the induced magnetic flux even in the peripheral direction of the thermal roller 26, so that the entire thermal roller 26 can be directly heated. For this reason, the inductive heating method can be used to even more uniformly heat up the thermal roller 26 using a simple configuration As shown in FIG. 5, the thermal roller 26 is formed in a three-layer configuration with an outer surface layer 49 serving as the outer peripheral surface of the thermal roller 26, an inner surface layer 50 serving as the inner 20 peripheral surface of the thermal roller 26, and an intermediate layer 51 sandwiched between the outer surface layer 49 and the inner surface layer 50. The outer surface layer 49 and the inner surface layer 50 are formed from magnetic material and have a larger magnetic reluctance than the magnetic reluctance of the propagation member 32. Example materials of the outer surface layer 49 and the inner surface layer 50 include iron, nickel, stainless steel, and other materials with a resistance of $3\times10^{-6}$ ohms×cm or more.

The intermediate layer 51 is formed with a material having higher thermal conductivity than that of the outer surface layer 49 and the inner surface layer 50. Examples for the material of the intermediate layer 51 include aluminum, copper, or other material with a thermal conductivity of 100 W/mK or greater.

With this three-layer configuration, a magnetic field results from propagation of induced magnetic flux formed in the axial direction of the thermal roller 26. The magnetic field generates induced current as eddy currents in the outer surface layer 49 and the inner surface layer 50 of the thermal roller 26. Therefore, induction heat can be efficiently generated in the roller contact portion 36 and proper thermal fixation can be achieved. Also, the intermediate layer 51 the intermediate layer 51 properly disperses heat because it is formed with a material having higher thermal conductivity than that of the outer surface layer 49. Therefore, even if local areas of the outer surface layer 49 are cooled off, for example, because they contact a sheet 3, the intermediate layer 51 properly disperses the heat from uncontacted portions of the outer surface layer 49, that is, portions that did not contact the sheet 3, and from the inner surface layer 50 to the cooled-off contacted portions of the outer surface layer 49. Therefore, problems such as the heated temperature of the thermal roller 26 rapidly cooling down or variation in the heated temperature at the surface of the thermal roller 26 can be properly prevented. For this reason, thermal fixation can be even more efficiently performed.

Figure 6:
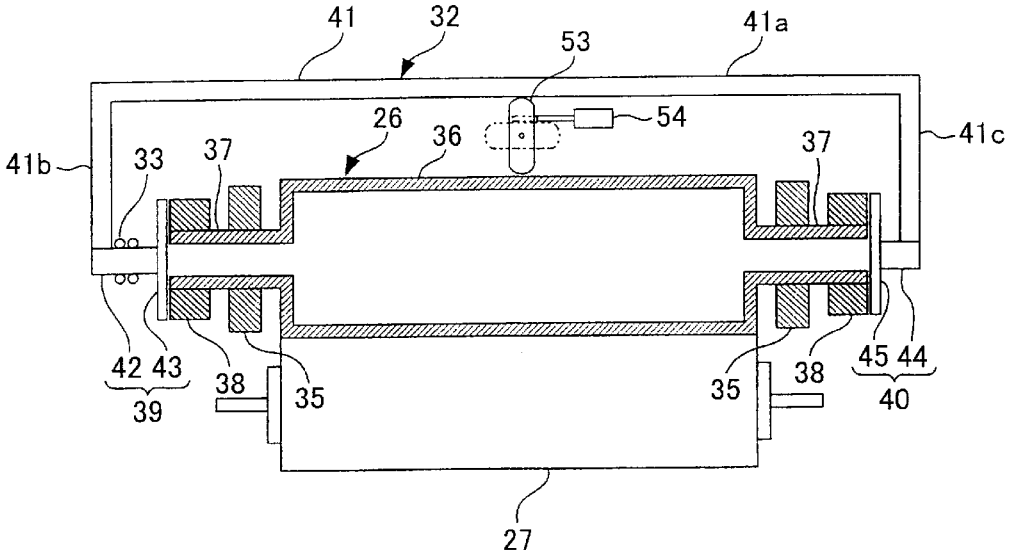
FIG. 6 is a cross-sectional view showing modification of the thermal device of the first embodiment.

FIG. 6 shows a modification of the thermal fixing device 18 of the first embodiment. In this modification, an intermediate connection member 53 and a solenoid 54 are provided in between the connection portion 41 and the thermal roller 26. The intermediate connection member 53 is made from the same ferrite material as the connection portion 41 and has the shape of a rectangle with both ends rounded The intermediate connection member 53 is located between the substantial lengthwise center of the connection portion 41 and the substantial axial-direction center of the roller contact portion 36. The solenoid 54 switches the intermediate connection member 53 between a connection orientation indicated by solid line in FIG. 6 and an interruption orientation indicated by broken line in FIG. 6, when the intermediate connection member 53 is in the connection orientation, the intermediate connection member 53 magnetically connects the substantial lengthwise center of the connection portion 41 and the substantial axial center of the thermal roller 26. When the intermediate connection member 53 is in the interruption orientation, magnetic connection between the substantial lengthwise center of the connection portion 41 and the substantial axial center of the thermal roller 26 is interrupted. The rounded ends of the intermediate connection member 53 facilitate smooth switching between the connection orientation and the interruption orientation.

When the solenoid 54 is driven to move its plunger shaft outward, then the intermediate connection member 53 is rotated into the interruption orientation substantially into parallel with the axial direction of the thermal roller 26. At this time, the ends of the intermediate connection member 53 do not magnetically connect the surfaces of the connection portion 41 and the roller contact portion 36 of the thermal roller 26. As a result, the induced magnetic flux generated by the induction coil 33 is propagated from one end of the thermal roller 26 to the other so that the entire axial length of the roller contact portion 36 is heated up.

On the other hand, when the solenoid 54 is driven to move its plunger shaft inward, then the intermediate connection member 53 is rotated into the connection orientation substantially perpendicular with the axial direction of the thermal roller 26. At this time, one end of the intermediate connection member 53 contacts the surface of the connection portion 41 and the other end of the intermediate connection member 53 moves to adjacent to the roller contact portion 36. Although the intermediate connection member 53 and the surface of the roller contact portion 36 are separated by a slight gap at this time, the intermediate connection member 53 is magnetically connected with the roller contact portion 36. As a result, in the connection orientation, the induced magnetic flux generated by the induction coil 33 is propagated to the substantial center of the connection portion 41 through the intermediate connection member 53 so that about half of the roller contact portion 36 in the axial direction heats up.

With this configuration, when the intermediate connection member 53 is oriented in the interruption orientation, induced magnetic flux propagates across the entire propagation member 32 connected to both axial ends of the thermal roller 26. Therefore, the entire axial length of the roller contact portion 36 of the thermal roller 26 is heated up. Also, when the intermediate connection member 53 is oriented in the connection orientation, the roller contact portion 36 is heated up to its substantial axial center because the substantial lengthwise center of the connection portion 41 and the substantial axial center of the thermal roller 26 are magnetically connected. For this reason, by switching the intermediate connection member 53 between its interruption orientation and its connection orientation, the heated up region of the roller contact portion 36 of the thermal roller 26 can be easily and reliably switched between all and half of the roller contact portion 36.

This can be effective, for example, when the size of the sheet 3 is changed. By changing the orientation of the intermediate connection member 53, the propagation pathway for induced magnetic flux through the propagation member 32 can be changed to an appropriate length so that the heated up region of the roller contact portion 36 matches the size of the sheet 3. For this reason, thermal fixing operations can be efficiently performed in accordance with the size of the sheet 3. It should be noted that the intermediate connection member 53 can be rotatably provided between any non-end positions of the propagation member 32 and the roller contact portion 36 to change the extent of the roller contact portion 36 that is heated up from half to some other portion of the entire the roller contact portion 36.

Figure 7:
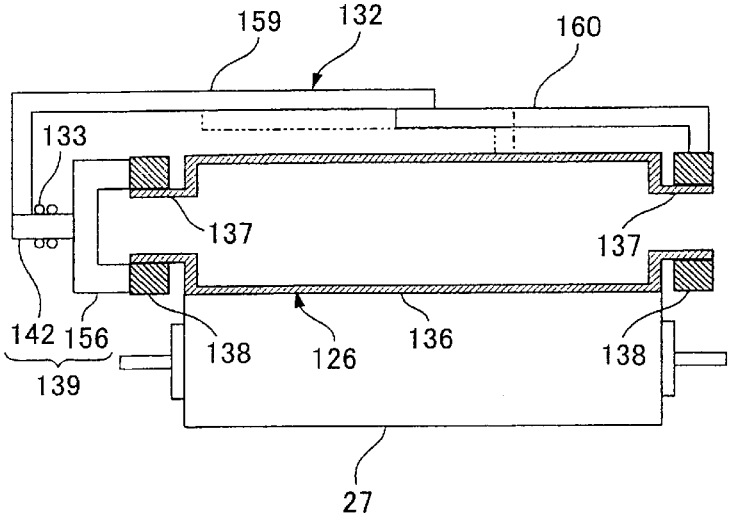
FIG. 7 is a cross-sectional view showing a thermal device according to a second embodiment of the present invention.

FIG. 7 shows a thermal fixing device 118 according to a second embodiment of the present invention. The thermal fixing device 118 includes a thermal roller 126 and a propagation member 132. The thermal roller 126 includes a roller contact portion 136, roller end portions 137, and magnetic reluctance reducers 138. The propagation member 132 includes a fixed-side connection propagation portion 159, a movable-side connection propagation portion 160, an end propagation portion 139, and a induction coil 133. The end propagation portion 139 includes a shaft portion 142 and a propagation fork 156.

The movable-side connection propagation portion 160 is provided slidably with respect to the thermal roller 126 following the axial direction of the thermal roller 126. The fixed-side connection propagation portion 159 is made from ferrite in a substantial L shape. The long section of the L shape is oriented to follow the axial direction of the thermal roller 126 and the free end of the short section of the L shape is connected to the shaft portion 142 of an end propagation portion 139, which is connected to the one end of the thermal roller 126.

Also, in the same manner as the fixed-side connection propagation portion 159, the movable-side connection propagation portion 160 is made from ferrite in a substantial L shape with the long section oriented to follow the axial direction of the thermal roller 126. The short section of the L shape is magnetically connected to, although separated by a slight gap from, the magnetic reluctance reducer 138 that is connected to the other end of the thermal roller 126. The roller contact portion 136 and the magnetic reluctance reducers 138 are formed with substantially the same outer diameter so that the short section of the movable-side connection propagation portion 160 can be slid across the roller contact portion 136 following the axial direction of the roller contact portion 136 by sliding movement of the movable-side connection propagation portion 160. When the movable-side connection propagation portion 160 is slid following the axial direction of the thermal roller 126, the outer surface of the long section of the movable-side connection propagation portion 160 slides along the inner surface of the fixed-side connection propagation portion 159.

The heated up region in the axial direction of the roller contact portion 36 can be adjusted as needed by sliding the movable-side connection propagation portion 160 by an appropriate distance along the thermal roller 26. Accordingly, the thermal fixing device 118 of the second embodiment enables easy and reliable adjustment of the heated up region so that thermal fixation can even more closely match the size of the sheet 3.

The magnetic reluctance reducers 138 in the thermal fixing device 118 according to the second embodiment also function as a bearing to rotatably support the thermal roller 26. That is, the magnetic reluctance reducers 138 have a ring shape fixedly supported by a fixed member (not shown) and the roller end portions 137 of the thermal roller 126 are rotatably supported at the inner surface of the magnetic reluctance reducers 138. As a result, the magnetic reluctance reducers 138 fill two functions in this manner. That is, the magnetic reluctance reducers 138 serve as support members in addition to serving as magnetic reluctance reducers. Therefore, the thermal fixing device 118 can be produced with fewer components. Further, the thermal roller 126 can be reliably heated using a simpler configuration.

As mentioned previously, the end propagation portion 139 at one of the roller end portions 37 includes the propagation fork 156 and the shaft portion 42. The propagation fork 156 has a substantial C shape as viewed in FIG. 7. The induction coil 133 is fitted around the outer peripheral surface of the shaft portion 142. Also, no end propagation portion is provided to the other roller end portion 137 Instead, the movable-side connection propagation portion 160 is magnetically connected to the magnetic reluctance reducer 138, although separated by a slight gap. With this configuration, the number of components can be reduced and the thermal roller 126 can be reliably heated using a simple configuration.

Accordingly, by providing the thermal fixing device 118 of the second embodiment in the printer 1, the induction-heating type thermal roller 126 for thermal fixing toner on sheets 3 can be uniformly heated using simple configuration with good durability.

While the invention has been described in detail with reference to specific embodiments thereof, it would be apparent to those skilled in the art that various changes and modifications may be made therein without departing from the spirit of the invention, the scope of which is defined by the attached claims.

For example, although the first embodiment describes the propagation plates 43, 45 of the propagation member 32 as having a substantially rectangular shape, this is not a limitation of the present invention. For example, the portion of the propagation member 32 for propagating induced magnetic flux to the thermal roller 26 can be formed in a ring shape so that the surface area that confronts the connection surface 46 of the magnetic reluctance reducers 38 can be increased so that induced magnetic flux can be even more efficiently propagated.

Figure 8:
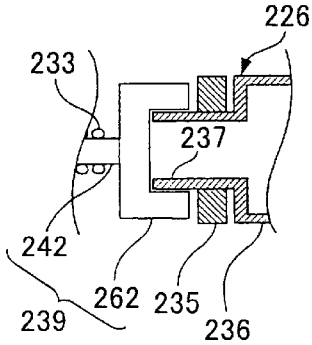
FIG. 8 is a cross-sectional view showing configuration for reducing magnetic reluctance without providing a separate magnetic reluctance reducer.

Further, the magnetic reluctance reducers 38 (138) need not be provided between the thermal roller 26 (126) and the propagation member 32 (132), depending on the objectives and use of the thermal fixing device 18 (118). For example, as shown in FIG. 8, an end propagation portion 239 can be formed from a shaft portion 242 and a substantially tube-shaped propagation portion 262, wherein the inner peripheral surface of the propagation portion 262 confronts the outer periphery of a roller end portion 237 of a thermal roller 226, separated by a predetermined gap. With this configuration, the surface area where the propagation portion 262 and the roller end portion 237 confront each can be increased by merely inserting the propagation portion 262 into the roller end portion 237. Induction magnetic flux can be properly propagated without providing any magnetic reluctance reducer.

Although the first embodiment describes the thermal roller 26 as having a three-layer configuration including the outer surface layer 49, the inner surface layer 50, and the intermediate layer 51, this is not a limitation of the present invention. The effects of the present invention can be achieved as long as the thermal roller includes at least one layer made from magnetic material. It is desirable that at least one layer be made with a material having a higher thermal conductivity than the thermal conductivity of the magnetic-material layer.

Figure 9:
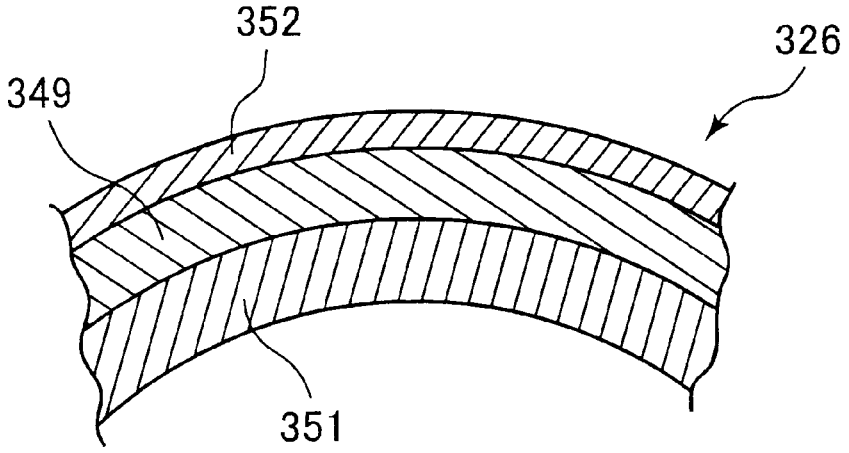
FIG. 9 is a cross-sectional view showing an example configuration for a thermal roller with a coating that facilitates separation of sheets from the thermal roller.
Figure 10:
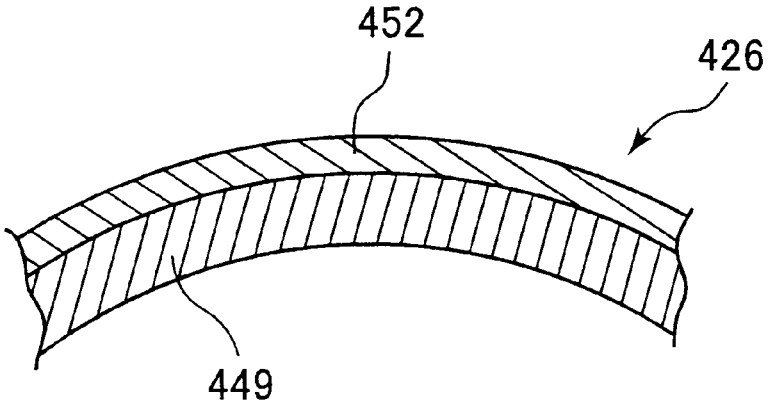
FIG. 10 is a cross-sectional view showing another example configuration for a thermal roller with a coating that facilitates separation of sheets from the thermal roller.

Also, it is desirable that the sheet-contacting outer surface of the thermal roller include a coating for facilitating separation of sheets from the thermal roller. FIG. 9 shows a thermal roller 326 including a thermal conducting layer 351, a magnetic layer 349, and a coating 352. The thermal conducting layer 351 has high thermal conductivity. Examples for the material of the thermal conducting layer 351 include aluminum, copper, or other material with a thermal conductivity of 100 W/mK or greater. The magnetic layer 349, which is made from a magnetic material, is formed on the surface of the thermal conducting layer 351. Example materials of the magnetic layer 349 include iron, nickel, stainless steel, and other materials with a resistance of $3\times10^{-6}$ ohms×cm or more. The coating 352 is made from silicone rubber or PFA (perfluoroalkoxy) and so facilitates separation of sheets from the thermal roller 326. FIG. 10 shows a thermal roller 426 including merely a magnetic layer 449 and a coating 452. The coating 452 is formed on the surface of the magnetic layer 449, which is made from a magnetic material. In this example also, the magnetic layer 449 is made from iron, nickel, stainless steel, or other material with a resistance of $3\times10^{-6}$ ohms×cm or more and the coating 452 is made from silicone rubber or PFA (perfluoroalkoxy) and so facilitates separation of sheets from the thermal roller 426.

What is claimed is:

1. A thermal fixing device for thermally fixing an image to a recording medium, the thermal fixing device comprising:

a magnetic circuit including:

an induction coil;

a propagation member made from a magnetic material that propagates magnetic flux induced by the induction coil; and a thermal member having a thermal region made from a magnetic material, the propagation member being magnetically connected to both ends of the thermal region of the thermal member so that the magnetic flux induced by the induction coil heats the thermal region of the thermal member-wherein the thermal member is configured from a plurality of layers, at least one layer being formed from a magnetic material and at least one layer being formed from a material with a thermal conductivity that is higher than thermal conductivity of the layer of magnetic material.

2. A thermal fixing device as claimed in claim 1, wherein the entire thermal region of the thermal member propagates the induced magnetic flux and is inductively heated up.

3. A thermal fixing device as claimed in claim 1, wherein the thermal member is movable and the induction coil and the propagation member are stationary, and further comprising a magnetic reluctance reducer disposed between the movable thermal member and at least one of the stationary propagation member and the stationary induction coil, magnetic reluctance reducer reducing magnetic reluctance between the stationary propagation member and the thermal region of the movable thermal member.

4. A thermal fixing device as claimed in claim 3, wherein the magnetic reluctance reducer is disposed between the stationary propagation member and the movable thermal member and increases confronting surface area between the propagation member and the thermal region of the movable thermal member.

5. A thermal fixing device as claimed in claim 3, wherein the magnetic reluctance reducer further serves as a support member for supporting the thermal member in a movable condition.

6. A thermal fixing device as claimed in claim 3, wherein the induction coil is mounted around the propagation member at a position external from a lengthwise direction end of the movable thermal member.

7. A thermal fixing device as claimed in claim 6, wherein the propagation member includes an end propagation portion disposed adjacent to the lengthwise direction end of the movable thermal member, the induction coil being mounted at the end propagation portion of the propagation member.

8. A thermal fixing device as claimed in claim 6, wherein the movable thermal member is a rotatable roller, the induction coil being disposed around the propagation member at a position external from an axial direction end of the roller, the roller formed with a surface having larger magnetic reluctance than magnetic reluctance of the propagation member.

9. A thermal fixing device as claimed in claim 1, wherein the propagation member is adapted for changing length of a pathway through the thermal region where the propagation member propagates the induced magnetic flux.

10. A thermal fixing device as claimed in claim 9, wherein the thermal member is movable and the propagation member includes:

a first propagation member magnetically connected to both lengthwise ends of the movable thermal member; and a second propagation member interposed between a non-end portion of the first propagation member and a lengthwise non-end portion of the movable thermal member;

the second propagation member being switchably movable between:

a connection orientation wherein the second propagation member magnetically connects the non-end portion of the first propagation member and the lengthwise non-end portion of the movable thermal member; and an interruption orientation wherein magnetic connection between the non-end portion of the first propagation member and the lengthwise non-end portion of the movable thermal member is interrupted.

11. A thermal fixing device as claimed in claim 9, wherein the thermal member is movable and the propagation member includes:

a first propagation member magnetically connected with a lengthwise end of the movable thermal member; and a second propagation member magnetically connected with another lengthwise end of the movable thermal member;

the first and second propagation members being mutually slidable along lengthwise portions thereof while maintaining magnetic connection therebetween, at least one of the first and second propagation members being slidable in the lengthwise direction of the movable thermal roller while maintained in a magnetically connected condition with the movable thermal roller.

12. A thermal fixing device as claimed in claim 1, wherein the thermal member includes two outer layers formed from a magnetic material, and an intermediate layer interposed between the outer layers, the intermediate layer being formed from a material with higher thermal conductivity than thermal conductivity of the outer layers.

13. A thermal fixing device as claimed in claim 1, wherein the thermal member includes a coating for facilitating separation of the recording medium from the thermal member, the coating being formed on the layer formed from a magnetic material.

14. A thermal fixing device as claimed in claim 1, wherein the thermal member is movable and further comprising a casing that covers the movable thermal member, the propagation member being provided integrally with the casing.

15. A thermal fixing device as claimed in claim 14, wherein the casing is freely detachably mounted on the movable thermal member, the propagation member including a casing-side propagation member and a connection-side propagation member that are separably connected to each other, the easing-side propagation member being provided to the casing and the connection-side propagation member being magnetically connected to the thermal member.

16. A thermal fixing device as in claim 1, further comprising:

a developing unit for forming the image; and a transfer unit for transferring the image onto the recording medium.

17. A thermal fixing device as in claim 1, wherein the thermal member is a tube-shaped roller.

18. A thermal fixing device for thermally fixing an image to a recording medium, the thermal fixing device comprising:

an induction coil;

a propagation member made from a magnetic material that propagates magnetic flux induced by the induction coil; and a thermal roller with a thermal region including an outer peripheral surface and an inner peripheral surface, at least one of the outer peripheral surface and the inner peripheral surface of the thermal region being formed from a magnetic material, the propagation member being magnetically connected to both axial lengthwise ends of the at least one of the outer peripheral surface and the inner peripheral surface.

19. A thermal fixing device as claimed in claim 18, wherein a magnetic circuit is formed by the propagation member being magnetically connected to both axial lengthwise ends of the at least one of the outer peripheral surface and at the inner peripheral surface, the magnetic circuit generating an eddy current at the at least one of the outer peripheral surface and the inner peripheral surface of the thermal region of the thermal member.

20. A thermal fixing device as in claim 18, further comprising:

a developing unit for forming the image; and a transfer unit for transferring the image onto the recording medium.

21. A thermal fixing device as in claim 18, wherein the thermal roller is a tube-shaped roller.

* * * * *